US006616435B2

(12) United States Patent
Lee et al.

(10) Patent No.: US 6,616,435 B2
(45) Date of Patent: Sep. 9, 2003

(54) APPARATUS OF POLYMER WEB BY ELECTROSPINNING PROCESS

(75) Inventors: Wha Seop Lee, Seoul (KR); Seong Mu Jo, Seoul (KR); Seok Gu Go, Seoul (KR); Suk Won Chun, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 0 days.

(21) Appl. No.: 09/824,031

(22) Filed: Apr. 3, 2001

(65) Prior Publication Data

US 2002/0122840 A1 Sep. 5, 2002

(30) Foreign Application Priority Data

Dec. 22, 2000 (KR) ..... 2000-80518

(51) Int. Cl.[7] ..... D04H 3/03

(52) U.S. Cl. ..... 425/83.1; 425/174.8 E; 425/382.2; 425/464

(58) Field of Search ..... 425/83.1, 174.8 E, 425/377, 382.2, 464

(56) References Cited

U.S. PATENT DOCUMENTS 2,116,942 A * 5/1938 Formhals ..... 425/174.8 E
2,168,027 A * 8/1939 Gladding ..... 425/83.1
2,810,426 A * 10/1957 Till et al. ..... 425/174.8 E
3,026,190 A * 3/1962 McMahon et al. ..... 264/12
3,280,229 A * 10/1966 Simons ..... 425/174.8 E
3,518,337 A * 6/1970 Nicolas ..... 264/176.1
4,233,014 A * 11/1980 Kinney ..... 425/174.8 E
6,106,913 A 8/2000 Scardino et al. ..... 428/36.3
6,110,590 A 8/2000 Zarkoob et al. ..... 428/364

OTHER PUBLICATIONS

Jayesh Doshi & Darrell H. Reneker, Electrospinning Process and Applications of Electrospun Fibers, Journal of Electrostatics, 1995, pp. 151–160.

* cited by examiner

*Primary Examiner*—James P. Mackey
*Assistant Examiner*—Joseph Leyson
(74) *Attorney, Agent, or Firm*—Rosenberg, Klein & Lee

(57) ABSTRACT

The present invention relates to an apparatus of polymer web by electrospinning process and manufacturing method thereof, which can manufacture porous polymer web using an electrospinning method. The method for manufacturing porous polymer web by electrospinning process includes the steps of: forming, pressurizing and supplying at least one or more kinds of polymer materials in a liquid state; and discharging and piling the polymer materials to a collector through one or more charged nozzles, the collector being located under the nozzles and charged to have a polarity opposed to the polarity of the charged nozzles, the collector moving in a prescribed speed.

10 Claims, 5 Drawing Sheets

APPARATUS OF POLYMER WEB BY ELECTROSPINNING PROCESS

BACKGROUND OF THE INVENTION

1. Field of the Invention

The present invention relates to an apparatus of polymer web by electrospinning process and manufacturing method thereof, and more particularly, to an apparatus of polymer web by electrospinning process and manufacturing method thereof, which can manufacture porous polymer web using an electrospinning method.

2. Description of the Related Art

In conventional fiber manufacturing skills, i.e., melt spinning, wet spinning, dry spinning and dry-jet wet spinning, fibers are manufactured by mechanically extruding and discharging a polymer melt or a polymer solution through nozzles and coagulating or solidifying it.

The fibers having several to several tens $\mu$m diameter can be manufactured, using the conventional process. Presently, ultra-fine threaded fibers of sub-micron to several $\mu$m diameters can be manufactured with only special polymers and manufactured by a very complex and restricted process using a method of dissolving a portion of the fibers.

Recently, it has been reported that an electrospinning process can adapt various kinds of polymers, such as polymer melt, polymer solution or the likes and manufacture fiber of several nanometer diameter.

Such fiber of small diameter is very high in a ratio of surface area to volume in comparison with the conventional fiber, makes the manufacture of film of high porosity possible, and can provide a new physical property not shown in the conventional products.

As the related report, "Electrospinning process and applications of electrospun fibers (J. Electrostatics, 35, 151–160 (1995)) by Doshi and Reneker is disclosed. In U.S. Pat. No. 6,106,913 by Frank, it is disclosed that very fine fiber of 4 Å~1 nm can be manufactured by combining the electrospinning process and an air vortex spinning technique. In U.S. Pat. No. 6,110,590, it is disclosed that biodegradable silk of 2 to 2000 nm diameter can be manufactured by using the electrospinning process.

Moreover, the electrospinning process is very simple, compared with the conventional methods, because directly manufacturing polymer web in a liquid state.

As polymers capable of being used in the electrospinning process, there are poly(vinylidenefluoride) (PVDF), poly(vinylidene fluoride-co-hexafluoropropylene), polyacrylonitrile, poly(acrylonitrile-co-methacrylate), polymethylmetha crylate, polyvinylchloride, poly(vinylidenechloride-co-acrylate), polyethylene, polypropylene, nylon series such as nylon12 and nylon-4,6, aramid, polybenzimidazole, polyvinylalcohol, cellulose, cellulose acetate, cellulose acetate butylate, polyvinyl pyrrolidone-vinyl acetates, poly(bis-(2-methoxyethoxyethoxy)) phosphazene(MEEP), poly(ethylene imide) (PEI), poly(ethylene succinate), poly(ethylene sulphide), poly(oxymethylene-oligo-oxyethylene), poly(propyleneoxide), poly(vinyl acetate), polyaniline, poly(ethylene terephthalate), poly(hydroxy butyrate), poly(ethylene oxide), SBS copolymer, poly(lacticacid), polypeptide, biopolymer such as protein, pitch series such as coal-tar pitch and petroleum pitch. Copolymers and blends of the above polymers may be used. Also, it is possible to use blends in which emulsions or organic or inorganic powders are blended in the above polymers.

However, the electrospinning process largely depends on the intensity of electric charge, differently from the conventional similar processes, such as electric coating, discharging by adding the intensity of electric charge to external physical power. Thus, it is very important that many nozzles are concentrated and used in a small area and each nozzle is controlled precisely to manufacture web made of fiber of fine diameter because one nozzle is restricted in increasing a discharge amount and productivity.

Especially, it is very important to concentrate several capillary nozzles on one spinning pack and discharge in large quantities. If the nozzles are simply arranged and used, since fibrous polymer stream discharged from each nozzle have electric charge, the fibrous polymer streams push to each other by a mutual interference and get out of an area of a collector. Furthermore, the nozzles perform non-uniform discharge because of different environments of capillary nozzles, and thereby it is difficult to manufacture a film of a uniform thickness.

Many reports of action of organic solution having electric charge have been known, but the electrospinning process using the polymers began to develop recently. Although the porous polymer web manufactured by the electrospinning method have various merits as described above, techniques to manufacture the polymer web in a high speed and large quantities have not been developed.

Especially, devices of a laboratory scale using one needle for experimentation can be easily constructed, and thereby it is possible to manufacture in a small quantity. However, for common use, mass production must be realized.

SUMMARY OF THE INVENTION

It is, therefore, an object of the present invention to provide an apparatus of polymer web by electrospinning process and manufacturing method thereof, which can manufacture porous polymer web having a high porosity and an excellent productivity by the way of an electrospinning process by polymers solutions or melts.

To achieve the object, the present invention provides an apparatus of polymer web by electrospinning process including: a barrel storing at least one or more kinds of polymer materials in a liquid state; a pump pressurizing and supplying the polymer materials of the liquid state stored in the barrel; a spinning part for injecting the polymer materials of the liquid state supplied by the pump through at least one or more charged nozzles and manufacturing thin fibers; a first high voltage generator providing electric charge for charging the polymer materials discharged through the nozzles of the spinning part to have one polarity; and a collector for piling and transferring the thin fibers to form the polymer web, the fibers being charged to have a polarity opposed to the polarity of the spinning part and discharged by the nozzles.

In another aspect, to achieve the object, the present invention provides a method for manufacturing polymer web by electrospinning process including the steps of: making, pressurizing and supplying at least one or more kinds of polymer materials in a liquid state; and discharging and piling the polymer materials to a collector through one or more charged nozzles, the collector being located under the nozzles and charged to have a polarity opposed to the polarity of the charged nozzles, the collector moving in a prescribed speed.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

The present invention will now be described in detail in connection with preferred embodiments with reference to the accompanying drawings.

Figure 1A:
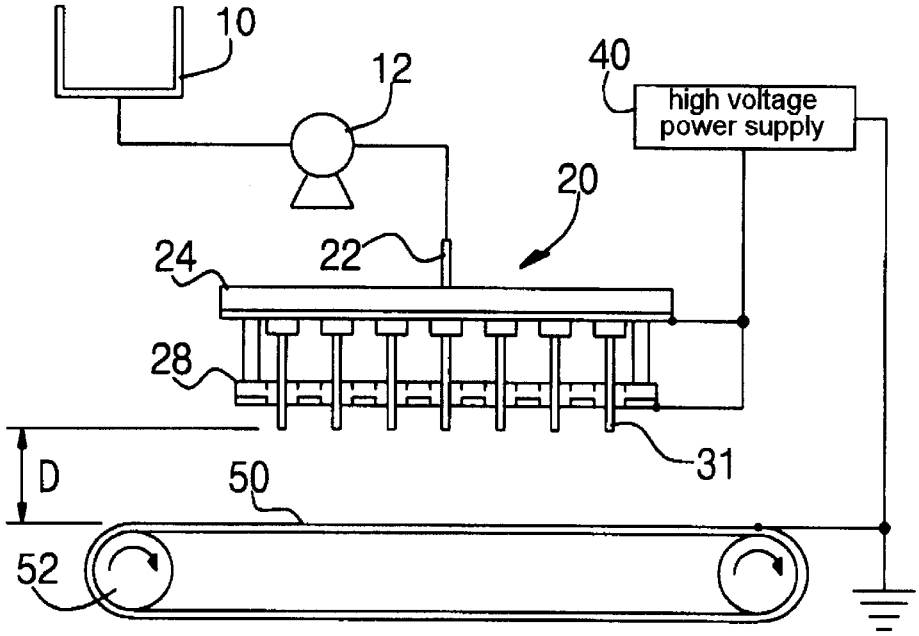
FIG. 1*a* is a view illustrating a structure of an electrospinning device according to a first preferred embodiment of the present invention.
Figure 1B:
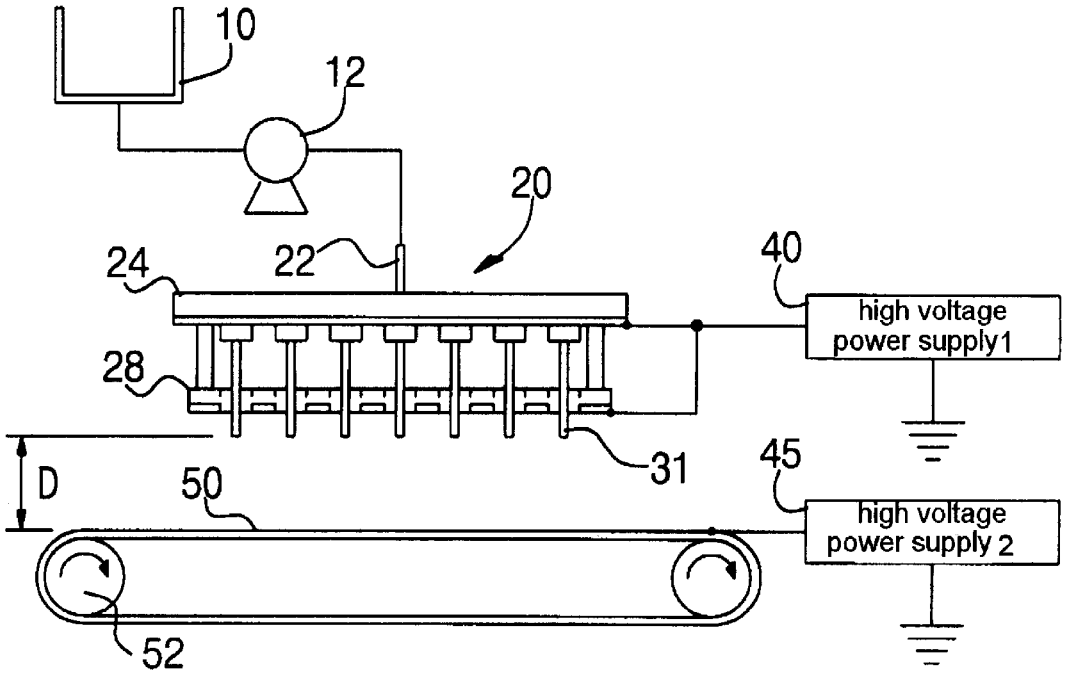
FIG. 1*b* is a view illustrating a structure of an electrospinning device according to a second preferred embodiment of the present invention.
Figure 3A:
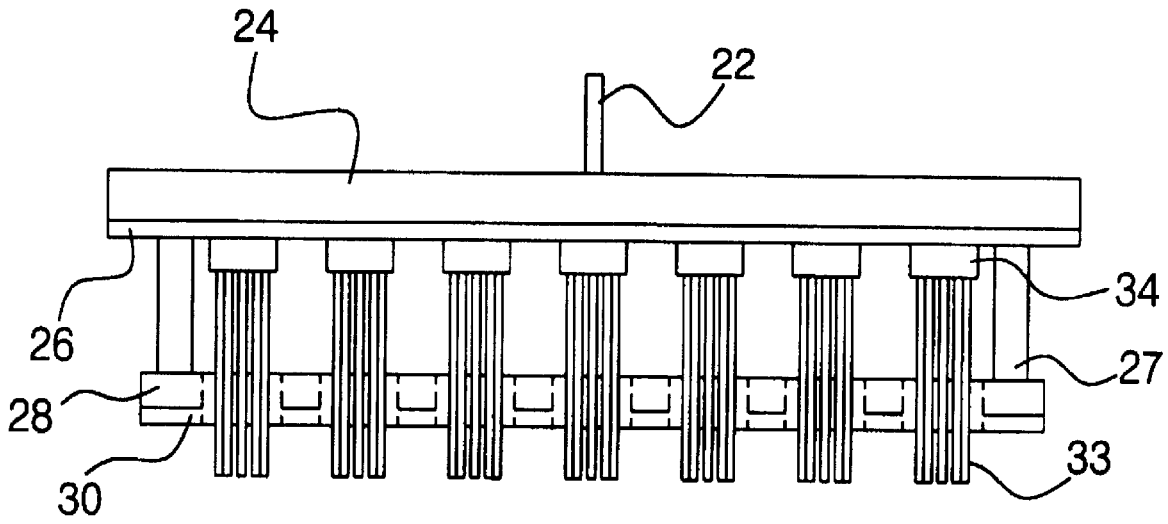
FIGS. 3*a* and 3*b* are views illustrating a structure of a spinning pack of the electrospinning device according to a second preferred embodiment of the present invention.

As shown in FIG. 1*a*, 1*b* and 3*a*, a polymer web manufacturing device by an electrospinning process according to a first preferred embodiment of the present invention includes a barrel 10 in which polymer materials are stored in a liquid state, a pump 12 pressurizing and supplying the polymer materials in the barrel 10 to spinning part 20, a spinning part 20 for manufacturing the polymer materials supplied by the pump 12 into fibers of a fine diameter, a collector 50 for piling the fibers spun in the spinning part 20 in an appropriate thickness and transferring it, and a high voltage generator 40 for supplying electric charge required during a spinning process of the spinning part 20.

The barrel 10 stores polymers dissolved by the solvent or melted polymer materials of at least one or more kinds. The polymer materials may be used in a state that various kinds of polymer materials are blended in one barrel or in a state that each polymer material is stored in each barrel.

In this embodiment according to the present invention, only one barrel 10 is illustrated but the barrel 10 may be used in the plural number.

The pump 12 is to pressurize and supply the polymer materials stored in the barrel 10 in the liquid state. If output of the pump 12 is adjusted, a spinning speed of the spinning part 20 can be adjusted.

Figure 2A:
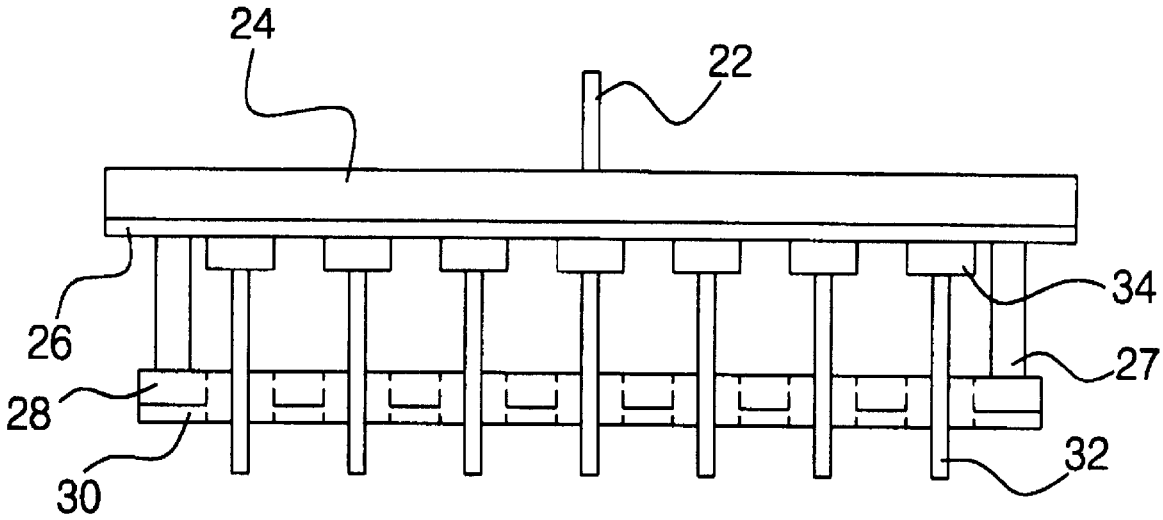
FIGS. 2*a* and 2*b* are views illustrating a structure of a spinning pack of the electrospinning device according to a first preferred embodiment of the present invention.
Figure 2B:
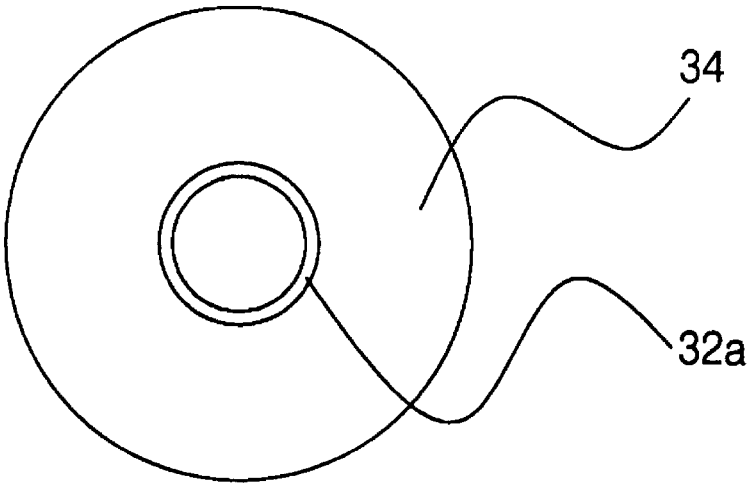
Figure 3B:
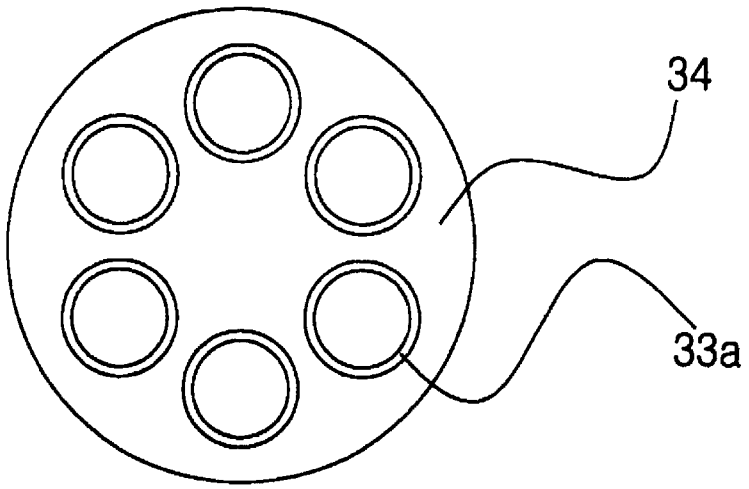

The spinning part 20 has a unitary nozzle type 32 shown in FIGS. 2*a* and 2*b* and a multi-nozzle type 33 shown in FIGS. 3*a* and 3*b*. The present invention will be described on the basis of the unitary nozzle type.

A base conductor board 26, which has a conductive part capable of transferring electric charge, is attached on a lower surface of a base 24 having an inlet pipe 22 receiving the polymer materials of the liquid state from the pump 12. The base conductor board 26 has a plurality of nozzle taps 34 projected at a lower surface thereof to mount the unitary nozzle 32.

Therefore, the base 24, the base conductor board 26 and the nozzle tap 34 respectively have a path for passing the polymer materials of the liquid state. Each path must have a structure allowing the polymer materials of the liquid state pressurized by the pump 12 to act on the nozzle taps 34 in the same pressure.

The nozzle tap 34 has only one injection hole, and the unitary nozzle 32 discharging the polymer materials of the liquid state is mounted in the injection hole. The unitary nozzle 32 is mounted at the center of the nozzle tap 34 as shown in FIG. 2*b*.

Here, a conductor board 30 for distributing charges is attached on the lower portion of the charge distribution board 28 in the same shape as the charge distribution board 28.

Voltages of the same polarity are applied to the base conductor board 26 and the conductor board 30 of the charge distribution board 28 and outputted by the high voltage generator 40.

The high voltage generator 40 outputs DC voltage of a range of 5 kV to 50 kV and has an anode output terminal connected to the conductor board 30 of the base conductor board 26 and a cathode output terminal is grounded.

For the nozzles 31, there are an unitary nozzle 32 shown in FIG. 2*b* and a multi-nozzle 33 having a plurality of discharge holes like a second embodiment of the spinning part 20 shown in FIGS. 3*a* and 3*b*.

The multi-nozzle 33 has a plurality of needles 33*a* arranged in a radial manner to minimize an electric interference between the nozzles 31. The needles of the multi-nozzle are arranged in intervals of 1 mm or more.

The charge distribution board 28 is induced to minimize the electric interference between the multi-nozzles 33.

The charge distribution board 28 can make the surroundings of the nozzles 31 equal. At this time, the conductor board 30, which is made of a conductor such as a metal, is attached on the charge distribution board 28, and the charge distribution board 28 has a hole larger than the nozzles 31, in which the nozzles 31 are inserted.

The conductor board 30 is located somewhat away from an end of the nozzles 31, i.e., from a terminal where the polymers are discharged, and it is preferable to keep the interval between the conductor board 30 and an end of nozzle 31 of 5 mm or more. Furthermore, it is preferable that a ratio of the length and the external diameter of the needles 32*a* and 33*a* of the nozzles 31 is more than 10, and more preferably, more than 20.

A second preferred embodiment of the spinning part 20 has the same structure as the first preferred embodiment, besides the structure of the nozzles (therefore, like reference numbers designate like components in FIGS. 2*a*, 2*b*, 3*a* and 3*b* showing the first and second embodiments).

The multi-nozzle 33 of the second preferred embodiment of the spinning part has the plural nozzles 33*a* arranged on the round nozzle taps 34 in equal distances and intervals from the center of the nozzle taps 34.

As shown in FIGS. 4*a* to 4*d*, the spinning part 20 has various types of nozzle alignment structures. It will be described hereinafter.

Figure 4A:
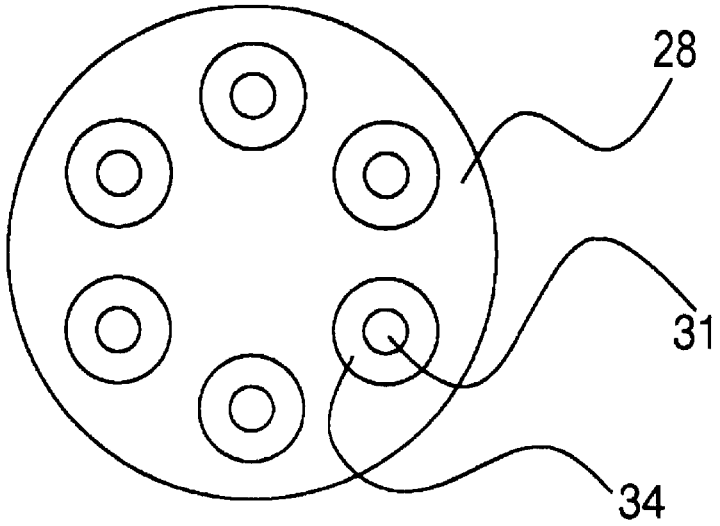
FIGS. 4*a* to 4*d* are exemplary views for showing various forms of a nozzle of the present invention.

In FIG. 4*a*, the base 24, the base conductor board 26 and the charge distribution board 28 are in the form of a round, and the plural nozzles 31 are aligned in equal distances and intervals from the center of the round.

Here, the nozzles 31 may adapt the structure of the unitary nozzle 32 or the multi-nozzle 33, and cases of FIGS. 4*b* to 4*d* to be described later are also the same.

Figure 4B:
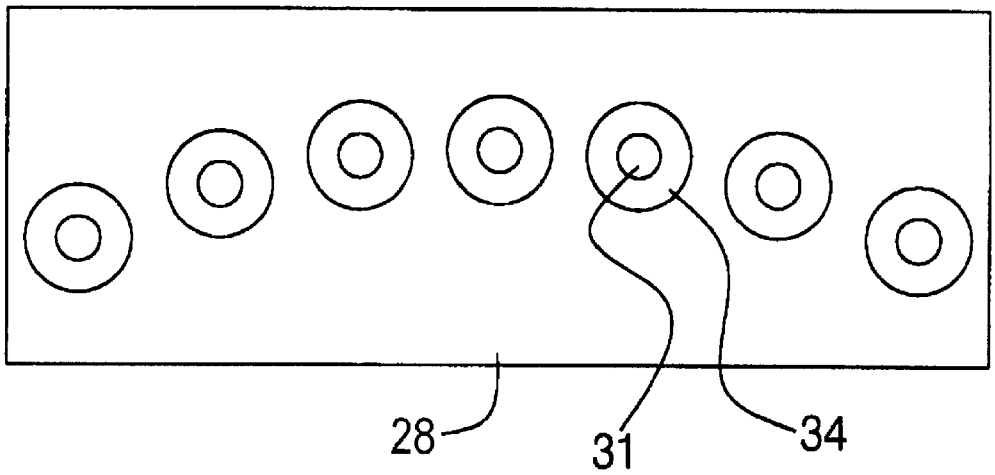

In FIG. 4*b*, the base 24, the base conductor board 26 and the charge distribution board 28 are in the form of a rectangle, and the plural nozzles 31 are aligned in an arc shape in equal intervals on the basis of a longitudinal line.

Figure 4C:
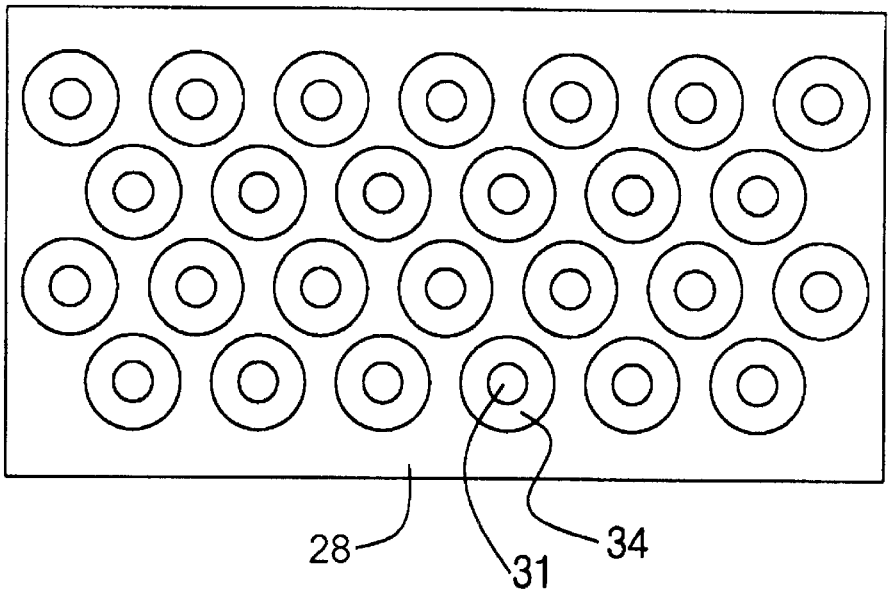

In FIG. 4*c*, the base 24, the base conductor board 26 and the charge distribution board 28 are in the form of a rectangle, the center of the plural nozzles 31 are located at intersecting points of consecutive triangles, and this structure makes the density of the aligned nozzles 31 high.

Figure 4D:
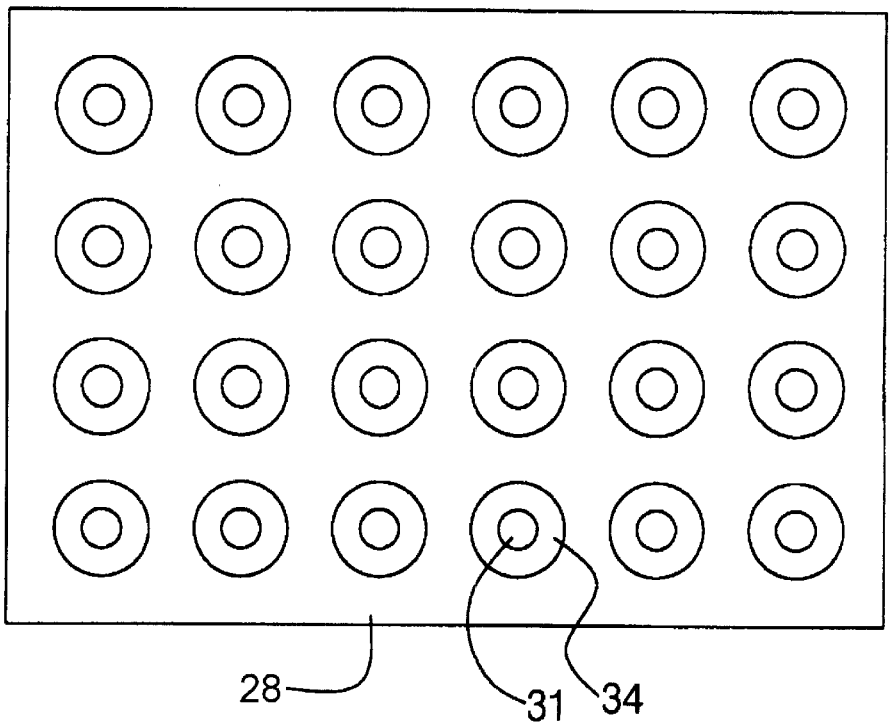

In FIG. 4*d*, the base 24, the base conductor board 26 and the charge distribution board 28 are in the form of a rectangle, and the center of the plural nozzles 31 are located at intersecting points of consecutive squares.

As shown in FIG. 1*a*, the method for charging the spinning part 20 and the collector 50 according the present invention uses one high voltage generator 40. The high voltage generator 40 has anodes connected to the base conductor board 26 and the conductor board 30 of the charge distribution board 28 for charging the polymer fibers discharged through the nozzles 31 into the anode and a cathode connected to the collector 50 and grounded.

In another embodiment, as shown in FIG. 1*b*, first and second high voltage generators 40 and 45 are used. The cathode outputs of the first high voltage generator 40 are connected to the base conductor board 26 of the spinning part 20 and the conductor board 30 of the charge distribution board 28 and charge the polymer fibers discharged through the nozzles 31 into the cathode. A ground terminal of the first high voltage generator 40 is grounded.

To more effectively accumulate the polymer fibers on the collector 50, charge opposed to the charge of the nozzles 31 and the conductor board 30 of the charge distribution board 28 may be applied to the collector 50.

For this, an anode output of the second high voltage generator 45 is connected to the collector 50, a ground terminal of the second high voltage generator 45 is grounded, and the output voltage is about −5 kV to −50 kV.

In the result, the same charge is applied to the nozzles 31 and the conductor board 30 of the charge distribution board 28 through the high voltage generator 40. At this time, the same poles, i.e., positive pole (+) and positive pole (+) or negative pole (−) and negative pole (−), are used, however, the present invention is not restricted in use of the same high voltage generators.

Therefore, +DC voltage is applied to the base conductor board 26 and the conductor board 30 of the charge distribution board 28 and −DC voltage is applied to the collector 50, and thereby the charges having opposite polarities to each other cause an attractive force to pile the polymer fibers discharged through the nozzles 31 on an upper surface of the collector 50 stably.

That is, because the surroundings of the nozzles 31 has the same environment and the nozzles 31 have a charge condition repelling from the upper portion to the lower portion of the needles 32*a* and 33*a*, the discharged polymer fibers are accumulated on the collector 50 in a small area and in the shortest path.

Meanwhile, a user can adjust a distance (D) between the spinning part 20 and the collector 50 to pile the polymer fibers on the upper surface of the collector 50 in the optimum state.

The collector 50 uses web made of metal or plates made of metal and is in the form of a conveyer belt operated by a roller 52 to transfer the polymer web piled on the upper surface thereof in one direction.

Using the polymer web manufacturing device by electrospinning process, a method for manufacturing the polymer web will be described hereinafter.

The polymer materials stored in the barrel 10 in the liquid state are pressurized and supplied by the pump 12. The pressurized polymer materials of the liquid state is pushed through the inlet pipe 22 and through fine holes of the nozzles 31 of the spinning part 20, and at the same time, if electric field is applied, polymer solution or polymer melt is discharged from the nozzle 31 by electric force, and thereby the polymer web is formed on the surface of the collector 50 located under the nozzles 31 in a prescribed distance.

The polymer web has a form that the fibers of several nanometer to several tens nanometer diameter are piled in three-dimensional network structure.

Because the polymer web has the fiber diameter of nanometer unit, a surface area per unit volume is very high. Therefore, the polymer web manufactured according to the present invention has very large porosity and surface area, compared with the polymer web manufactured by the conventional methods.

Because the polymer materials are directly manufactured from the liquid state to a solid state into the form of the polymer web having a microscopic fibrousness structure, the present invention has very simple device and manufacturing process and a very high economical efficiency due to reducing the manufacturing period of time.

Moreover, the present invention can manufacture porous polymer web having various forms and thickness according to the need because the diameter of the fibrousness (several nanometer to several tens nanometer), the thickness of the film (several $\mu$m to several tens $\mu$m) and the size of a pore can be easily adjusted by changing manufacturing conditions.

If the electrospinning process is used, the process is simplified and the fibers of several nanometer to several tens nanometer diameter is piled in a multi-dimensional structure, thereby showing an excellent mechanical and physical property, compared with the film manufactured by a method of casting a solvent having equal pores.

The manufacturing method of the porous polymer web will be described in more detail hereinafter.

The polymers are dissolved in the solvent or made into the polymer melt. The liquid type polymers are inserted into the barrel 10. Voltage of 5 kV to 50 kV is applied to the nozzles 31 of the spinning part 20 and the polymers are discharged on the collector 50 in a prescribed speed to manufacture the high porous polymer web.

The thickness of the porous polymer web can be adjusted by changing the process conditions such like the applied electric force, the deposition time on collector, the discharge speed (i.e., change of the discharge speed using the change of virtual pressure of the pump). As the electrospinning method, there are a porous polymer web manufacturing method including the steps of inserting various polymer materials into one barrel 10, spinning with one or more nozzles 31 and blending the polymers completely, and a high porous polymer web manufacturing method including the steps of inserting various polymer materials into each barrel 10 and spinning the polymers through the nozzles 31 at the same time to make the polymer fibers be entangled with each other.

To manufacture the high porous polymer web, it is preferable to use one or more nozzles 31. Here, if the nozzles 31 are simply arranged and used, since the polymers of fibrousness discharged from each nozzles 31 have electric charge, the polymers push to each other by a mutual interference and get out of an area of the collector 50. Furthermore, the nozzles 31 perform the non-uniform discharge because of different environments of capillary nozzles 31, and thereby it is difficult to manufacture a film of a uniform thickness.

Therefore, to improve the productivity and the quality of the polymer web, it is necessary to increase a dense degree of the nozzles 31, to make the charge condition of the nozzles 31 equal and to minimize a movement path of the polymers of fibrousness discharged through the nozzles 31.

The method for manufacturing polymer web by electrospinning process will be described through embodiments having different conditions.

Embodiment 1

80 g dimethylacetamide and 20 g polyvinylidene fluoride (Atochem, Kynar 761) were mixed and agitated at 70° C. for 24 hours to obtain transparent polymer solution.

The polymer solution was inserted into the barrel 10, voltage of 8 kV to 12 kV was applied to the forty two unitary nozzles 32, each of which has one needle 32*a*, and the conductor board 30 of the charge distribution board 28, and the collector 50 was grounded.

A distance between the end of the needle 32*a* of the unitary nozzle 32 and the charge distribution board 28 was 1.0 cm and a distance (D) between the end of the needle 32*a* and the collector 50 was 8 cm.

At this time, the collector 50 did use web made of metal, and the movement speed of the web was 10 m/min. A thickness of the manufactured porous polymer web was measured with micrometer and the result is shown in a table 1.

TABLE 1

| Applied voltage (kV) | Polymer discharge speed of needle (μl/min) | Thickness of accumulated film (μm) |
|---|---|---|
| 8 | 160 | 25 |
| 9 | 170 | 33 |
| 10 | 180 | 37 |
| 12 | 200 | 48 |

Embodiment 2

80 g acetone and 20 g polyvinylidene fluoride (Atochem, Kynar 761) were mixed and agitated at 70° C. for 24 hours to obtain transparent polymer solution.

The polymer solution was inserted into the barrel 10, voltage of 8 kV to 12 kV was applied to the five multi-nozzles 33, each of which has twelve needles 33*a*, and the conductor board 30 of the charge distribution board 28, and the collector 50 was grounded.

A distance between the end of the needle 32*a* of the multi-nozzle 33 and the charge distribution board 28 was 1.2 cm and a distance (D) between the end of the needle 33*a* of the multi-nozzle 33 and the collector 50 was 14 cm.

At this time, the collector 50 did use web made of metal, and the movement speed of the web was 15 m/min. A thickness of the manufactured porous polymer web was measured with micrometer and the result is shown in a table 2.

TABLE 2

| Applied voltage (kV) | Polymer discharge speed of needle (μl/min) | Thickness of accumulated film (μm) |
|---|---|---|
| 8 | 160 | 51 |
| 9 | 170 | 60 |
| 10 | 180 | 72 |
| 12 | 200 | 79 |

Embodiment 3

80 g dimethylacetamide and 20 g polyacrylonitrile (PolyScience Co.) were mixed and agitated at 70° C. for 24 hours to obtain transparent polymer solution.

The polymer solution was inserted into the barrel 10, voltage of 8 kV to 16 kV was applied to the two multi-nozzles 33, each of which has four needles 33*a*, and the conductor board 30 of the charge distribution board 28, and the collector 50 was grounded.

A distance between the end of the needle 32*a* of the multi-nozzle 33 and the charge distribution board 28 was 1.6 cm and a distance (D) between the end of the needle 33*a* of the multi-nozzle 33 and the collector 50 was 15 cm.

At this time, the collector 50 did use web made of metal, and the movement speed of the web was 3 m/min. A thickness of the manufactured porous polymer web was measured with micrometer and the result is shown in a table 3.

TABLE 3

| Applied voltage (kV) | Polymer discharge speed of needle (μl/min) | Thickness of accumulated film (μm) |
|---|---|---|
| 3 | 140 | 24 |
| 10 | 160 | 32 |
| 14 | 180 | 41 |
| 16 | 220 | 50 |

Embodiment 4

80 g acetone and 20 g polyvinylidene fluoride (Atochem, Kynar 761) were stirred and dissolved (A solution). 80 g dimethylacetamide, 10 g polyvinylidene fluoride (Atochem, Kynar 761) and 10 g polyacrylonitrile (Polyscience, molecular weight of 150,000) were mixed and agitated at 70° C. for 24 hours to obtain transparent polymer solution (B solution). Dimethylacetamide of 83 g and polyacrylonitrile of 17 g were mixed to obtain transparent solution (C solution).

The A, B and C solutions were inserted into the three barrel 10, the each polymer solution was inserted into three multi-nozzles 33 respectively, each of which has twenty two needles 33*a*, voltage of 10 kV to 16 kV was applied to the multi-nozzles 33 and the conductor board 30 of the charge distribution board 28, and the collector 50 was grounded. multi-nozzle 33 and the charge distribution board 28 was 1.4 cm and a distance (D) between the end of the needle 33*a* of the multi-nozzle 33 and the collector 50 was 10 cm.

The collector 50 did use web made of metal, and the movement speed of the web was 3 m/min. A thickness of the manufactured porous polymer web was measured with micrometer and the result is shown in a table 4.

TABLE 4

| Applied voltage (kV) | Polymer discharge speed of needle (μl/min) | Thickness of accumulated film (μm) |
|---|---|---|
| 10 | 140 | 63 |
| 12 | 160 | 70 |
| 14 | 180 | 79 |
| 16 | 220 | 85 |

As described above, according to the present invention, the porous polymer web can be manufactured in a high speed by using the electrospinning process. The manufactured porous polymer web may be used for the purpose of a separator of a secondary batteries, a polymer electrolyte membranes, a separator of a fuel cell, a filter, and dressing for medical treatment.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An apparatus of polymer web by electrospinning process, the apparatus comprising:

a barrel storing at least one or more kinds of polymer materials in a liquid state;

a pump pressurizing and supplying the polymer materials of the liquid state stored in the barrel;

a spinning part for injecting the polymer materials of the liquid state supplied by the pump through at least one or more charged nozzles and manufacturing thin fibers, the spinning part further comprising:

a base having an inlet pipe formed at the center and a path for passing the polymer materials of the liquid state within, the inlet pipe receiving the polymer materials of the liquid state from the pump;

a base conductor board attached on a lower surface of the base and having a conductive plate for transferring electric charge, the base conductor board having a plurality of nozzle taps for mounting the nozzles at a lower surface thereof;

at least one or more nozzles mounted on the nozzle taps formed on the base conductor board for discharging the polymer material;

a charge distribution board mounted on a lower portion of the base conductor board, the charge distribution board having a plurality of holes formed at the positions, where the nozzles are mounted, for passing the nozzles; and a conductor board mounted on a lower portion of the charge distribution board for charge distribution;

a first high voltage generator providing electric charge for charging the polymer materials discharged through the at least one or more nozzles of the spinning part to have one polarity; and a collector for piling and transferring the thin fibers to form the polymer web, the collector being charged to have a polarity opposed to the polarity of the spinning part and to the charged fibers discharged by the nozzles.

2. The apparatus as claimed in claim 1, wherein the pump controls a discharged amount of the polymer materials discharged through the nozzles.

3. The apparatus as claimed in claim 1, wherein the at least one or more nozzles is either a unitary nozzle, which has a needle discharging the polymer materials of the liquid state, or a multi-nozzle, which has a plurality of needles.

4. The apparatus as claimed in claim 3, wherein the at least one or more nozzles is a multi-nozzle, and the needles of the multi-nozzle are arranged in intervals of at least 1 mm.

5. The apparatus as claimed in claim 3, wherein each needle has a ratio of a length to an external diameter which is at least 10.

6. The apparatus as claimed in claim 1, wherein the collector is in a web structure of conductive materials or a plate structure of the conductive materials.

7. The apparatus as claimed in claim 1, wherein the collector is in a conveyor belt for transferring the polymer web piled on the upper portion thereof in one direction.

8. The apparatus as claimed in claim 1, wherein the collector further includes a second high voltage generator for supplying electric charge of polarity opposed to the polarity of the spinning part.

9. The apparatus as claimed in claim 1, wherein the charge distribution board is located upwardly at a distance of at least 5 mm from an end of the at least one or more nozzles discharging the polymer materials.

10. The apparatus as claimed in claim 8, wherein output voltage of the first and second high voltage generators is DC voltage having an absolute value of 1 kV to 50 kV.

* * * * *